US005348400A

United States Patent [19]

Haiss et al.

[11] Patent Number: 5,348,400

[45] Date of Patent: Sep. 20, 1994

[54] TUBE-POUCH WITH OPENING ACCESSORY

[75] Inventors: Manfred Haiss, Waldenbuch, Fed. Rep. of Germany; Wilfried Jud, St. Pölten, Austria

[73] Assignee: Teich Aktiengesellschaft, Austria

[21] Appl. No.: 129,306

[22] Filed: Sep. 30, 1993

[30] Foreign Application Priority Data

Sep. 30, 1992 [AT] Austria ..... 1928/92

[51] Int. Cl.[5] ..... B65D 33/16; B65D 65/10; B65D 65/32

[52] U.S. Cl. ..... 383/210; 229/87.08; 383/82

[58] Field of Search ..... 383/210, 211, 81, 82; 229/87.08

[56] References Cited

U.S. PATENT DOCUMENTS

| | | | |
|---|---|---|---|
| 2,162,285 | 6/1939 | Scott | 383/78 |
| 2,322,654 | 6/1943 | Moore | 383/210 |
| 3,410,393 | 11/1968 | Lee | 383/211 |
| 3,439,866 | 4/1969 | Kuhnle | 383/78 |
| 4,826,011 | 5/1989 | Jud | 229/87.08 |
| 4,917,247 | 4/1990 | Jud | 229/87.08 |
| 4,997,289 | 5/1991 | Sasaki et al. | 383/211 |
| 5,184,771 | 2/1993 | Jud et al. | 383/211 |

FOREIGN PATENT DOCUMENTS 464429 4/1937 United Kingdom .

*Primary Examiner*—Stephen P. Garbe
*Attorney, Agent, or Firm*—Bacon & Thomas

[57] ABSTRACT

The invention concerns a tube-pouch wrap comprising a fin 2 within which two strip edges 3 of the wrapping material are joined together at their inner sides by a peelable cold seal, the junction area including one sub-section 4 at each end of the two edge strips 3 and an unsealed middle zone 5 being present between said subsections. An adhesive label 6 is folded about the fin edge 8 to connect the two edge strips 3 of the fin to close the wrap hermetically and to serve as an opening accessory, said adhesive label covering the middle zone 5 and overlapping the two sub-sections of the fin 2 by bonding to the fin surface. At one side of the fin, the adhesive label 6 comprises a strip edge 11 forming a grip 12 unbonded to the fin surface. Advantageously the fin 2 is so folded on the wrap envelope 13 and bonded to it that the grip 12 is uppermost.

4 Claims, 2 Drawing Sheets

TUBE-POUCH WITH OPENING ACCESSORY

The invention concerns a tube-pouch wrap with an opening accessory for piece-goods, comprising an envelope comprised of a planar, foldable wrapping material and a fin wherein two edge-strips of the wrapping material are connected together by a peelable cold-seal at their inner sides within a junction zone. A tube-pouch wrap of this kind is known from the patent document WO 91/13005 of applicant. In the tube-pouches described therein, the opening accessories comprise edge-strips which are each fitted with a grip, which upon being manually pulled apart, cause the cold-seal junction between the two edge-strips to disengage and form an aperture in the wrap to remove the wrapped goods.

One drawback of this known opening accessory is the need to use both hands to open the package and that the grips needed for opening are not immediately recognized as such without special explanation or instruction by a user as yet unfamiliar with the wrap. Moreover the opening procedure frequently results in damage to the wrapping material and the removal of the wrapped goods is made more difficult thereby.

The object of the invention is to remedy this drawback. As characterized in the claims, the invention solves the problem by creating a tube-pouch wrap with an opening accessory requiring only one hand for opening and for which the manipulation necessary for opening is easily ascertained by a user.

DETAILED DESCRIPTION

The invention is illustrated below by two illustrative embodiments and in relation to the Figures.

Figure 1:
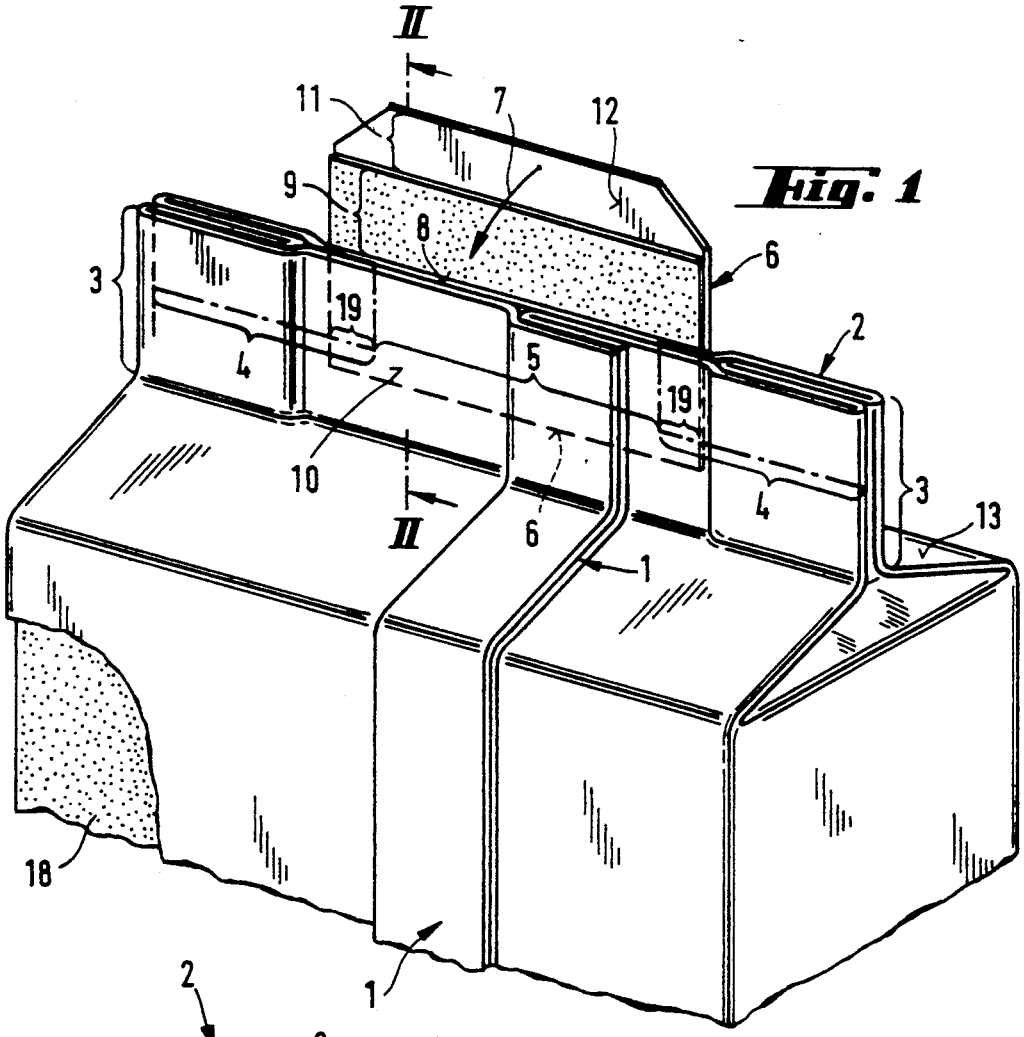
FIG. 1 is a partial view in perspective of a tube-pouch wrap.

FIG. 1 is a partial view in perspective of a tube-pouch wrap useful, for example, for storable bakery goods and chocolate bars. The wrapping material is shown here and also in the other Figures in exaggeratedly thick manner for greater clarity. In the manner conventional for tube-pouch wraps, the wrap comprises a strap 1 and fins 2 running transversely to the ends of said strap 1, though the partial schematic of FIG. 1 shows only one fin. The strap 1 and the fin 2 form essentially mutually orthogonal wrap zones wherein two edge-strips 3 of the wrap are connected in a junction area by cold-sealing at the surface side which ordinarily faces the wrapped goods 18.

Countrary to the case of conventional tube-pouch wraps in which junction areas extend over the length of the two edge strips forming the fins, the junction area of the tube-pouch wrap of the invention at the fin 2 is in the form of two sub-sections 4 present at both ends of the edge strips and shown in FIG. 1 by a shaded contour. An unsealed middle zone 5 is located between said sub-section 4 which form the junction area.

Figure 2:
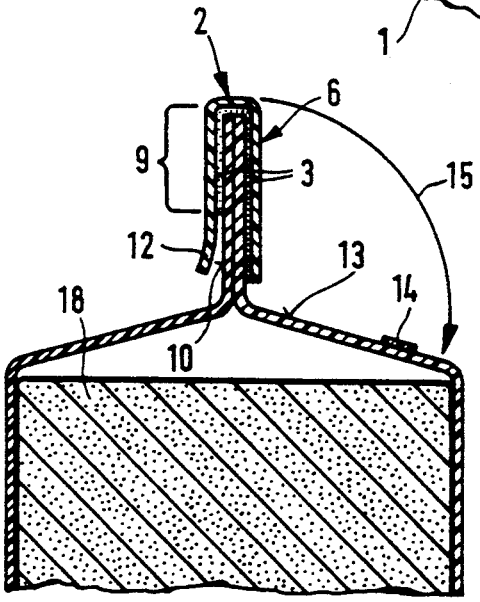
FIG. 2 is a cross-sectional view of the tube-pouch wrap taken along line II—II in FIG. 1.
Figure 3:
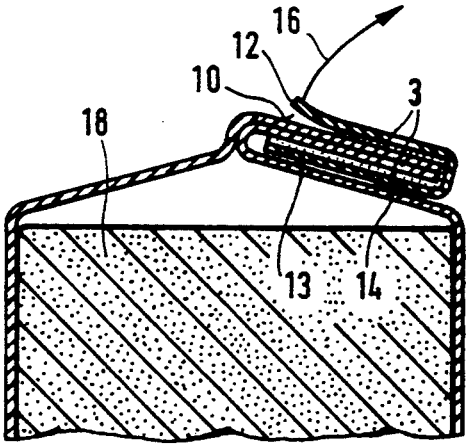
FIG. 3 is a view similar to FIG. 2 but illustrating the sealing fin bonded to the surface of the wrap.
Figure 4:
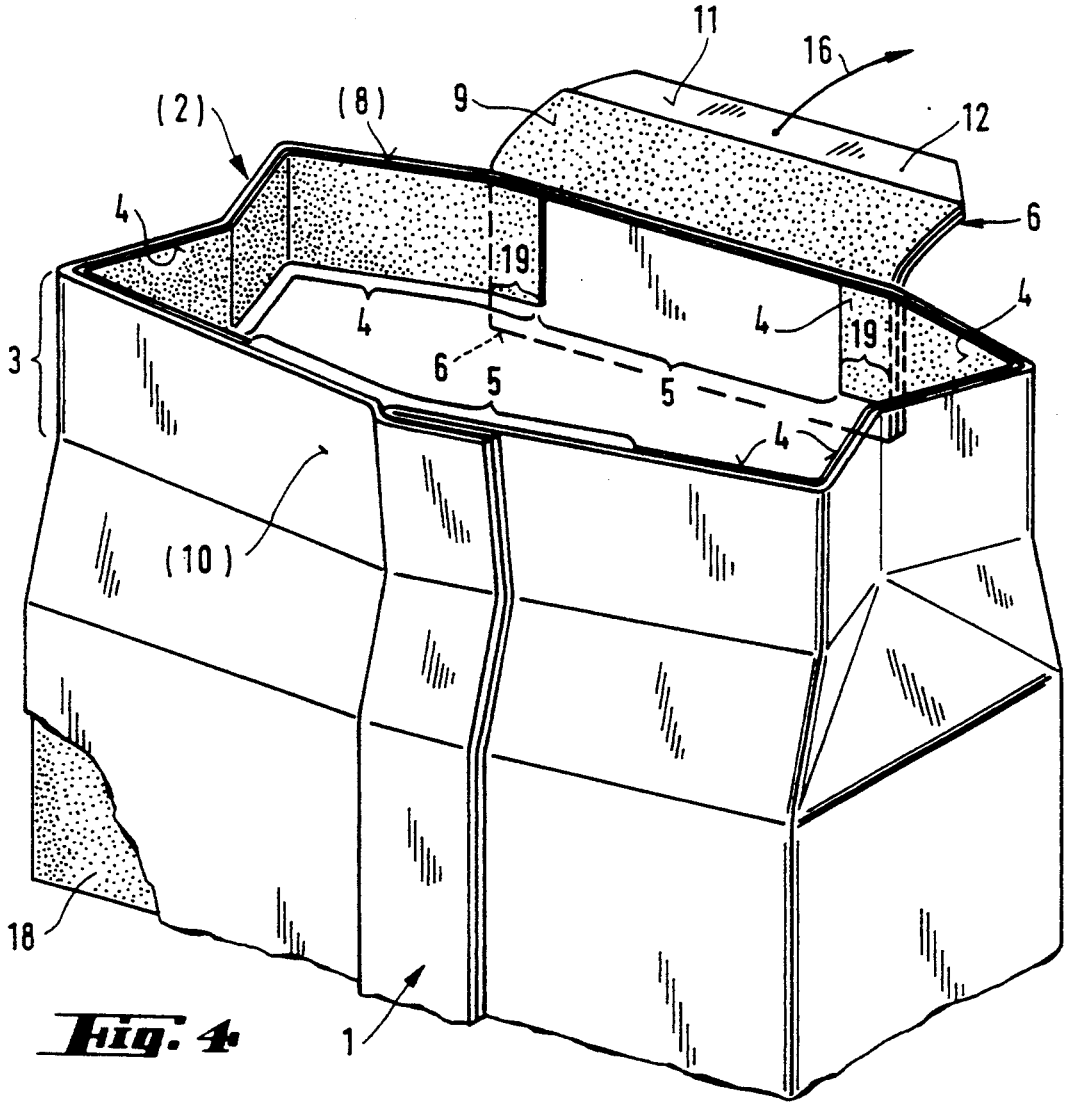
FIG. 4 illustrates the tube-pouch wrap in open condition.

An adhesive label 6 serves hermetically seal the two edge strip 3. Following the manufacture of the basic shape of the tube-pouch wrap, that is, after the fin 2 has been made, the adhesive label 6 is first affixed by a highly adhesive bond to the outside of one of the two edge strips 3, in such a way it covers the unsealed middle zone 5 and overlaps (19) the two sub-sections 4 of the junction area. Thereupon the adhesive label 6 is folded in the direction of the arrow 7 about the fin edge 8, and zone 9 which contains a peelable deposit of adhesive is joined to the opposite fin surface 10, an edge strip 11 devoid of adhesive deposit remaining unbonded to the fin surface 10 and thereby forming a grip 12. This condition is shown in the cross-section of FIG. 2 corresponding to an enlarged section along line II—II of FIG. 1. Next hot melt dots 14 (FIG. 2) are deposited on the surface 13 of the wrap envelope at the side of the fin 6 which is opposing the grip 12 and immediately thereafter the fin is folded back in the direction of the arrow 15 (FIG. 2) onto the wrap envelope and in the process is bonded by the hot-melt deposit to the envelope surface 13 as shown in FIG. 3. To open the finished tube-pouch wrap as shown in FIG. 3, in a manner at once evident to the user, the grip 12 is seized by one hand and pulled upward and sideways in the direction of the arrow 16. In this manner, the peelable bond between the adhesive label 6 and the fin 2 is broken. Next the two sub-sections 4 of the junction area of the fin are peeled apart and, following separation of the hot melt bond between the fin 2 and the envelope surface 13, the end of the tube-pouch wrap is unfolded. The tube-pouch wrap is then opened as shown by FIG. 4.

Figure 5:
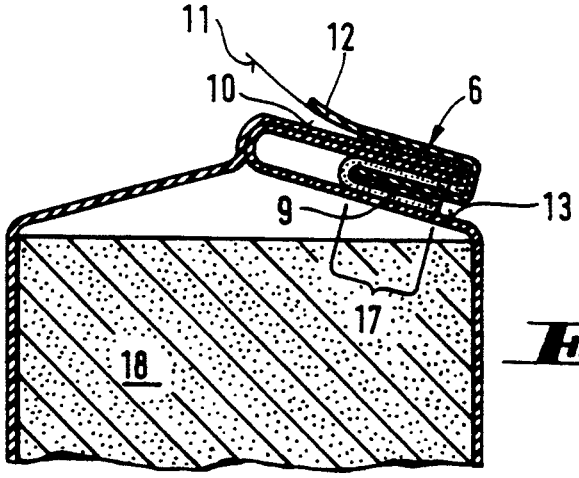
FIG. 5 illustrates an alternative embodiment of the invention.

In an alternate embodiment of the invention shown in FIG. 5, an edge strip 17 of the adhesive label 6 is folded by 180° at the fin side which is bonded to the wrap envelope-surface 13, whereby this edge strip 17 bonds in the desired manner to the wrap envelope-surface 13 when the fin 2 is folded over.

We claim:

1. A tube-pouch wrap with an opening accessory for piece goods, comprising an envelope comprised of a planar, foldable wrapping material having a fin in which two edge strips of the wrapping material are bonded to each other by a peelable cold seal at their inner sides within a junction area, said junction area comprising a sub-section at each end of the edge strips separated by an unsealed middle zone on said edge strips between said sub-sections and an adhesive label folded about the fin so as to cover the unsealed middle zone and overlap the two sub-sections of the junction area and sealed on both sides of the fin, said adhesive label comprising an unsealed edge strip forming a grip on one side of the fin.

2. Tube-pouch defined in claim 1, wherein the fin is folded about the envelope and is bonded to the surface of the envelope.

3. Tube-pouch defined in claim 2, wherein the grip lies at the top of the folded fin.

4. Tube-pouch defined in claim 3, wherein an edge strip of the adhesive label is folded by 180° at the fin side, said edge strip being bonded to the envelope when the fin is folded about the envelope.

* * * * *